US007988271B2

(12) United States Patent
Ohnishi et al.

(10) Patent No.: US 7,988,271 B2
(45) Date of Patent: Aug. 2, 2011

(54) INK JET PRINTER, INK SUPPLY MECHANISM FOR THE INK JET PRINTER, AND INK SUPPLY METHOD

(75) Inventors: Masaru Ohnishi, Kawanishi (JP); Hitoshi Sato, Ueda (JP)

(73) Assignee: Mimaki Engineering Co., Ltd., Nagano (JP)

( * ) Notice: Subject to any disclaimer, the term of this patent is extended or adjusted under 35 U.S.C. 154(b) by 234 days.

(21) Appl. No.: 12/418,999

(22) Filed: Apr. 6, 2009

(65) Prior Publication Data

US 2009/0251506 A1 Oct. 8, 2009

Related U.S. Application Data

(63) Continuation of application No. 10/548,335, filed as application No. PCT/JP03/16911 on Dec. 26, 2003, now Pat. No. 7,533,974.

(30) Foreign Application Priority Data

Jan. 31, 2003 (JP) ..... 2003-025193

(51) Int. Cl.
*B41J 2/175* (2006.01)
*B41J 2/165* (2006.01)

(52) U.S. Cl. ..... 347/85; 347/22

(58) Field of Classification Search ..... 347/5, 7, 347/21, 22, 49, 85, 86
See application file for complete search history.

(56) References Cited

U.S. PATENT DOCUMENTS

| | | | | |
|---|---|---|---|---|
| 4,320,406 | A | 3/1982 | Heinzl | |
| 4,437,104 | A | 3/1984 | Hudson | |
| 4,447,820 | A | 5/1984 | Terasawa | |
| 4,636,814 | A | 1/1987 | Terasawa | |
| 4,695,851 | A | 9/1987 | Terasawa | |
| 4,965,596 | A | 10/1990 | Nagoshi et al. | |
| 5,523,780 | A | 6/1996 | Hirosawa et al. | |
| 5,638,097 | A * | 6/1997 | Takayanagi et al. | 347/7 |
| 6,206,511 | B1 | 3/2001 | Cook et al. | |
| 6,234,603 | B1 | 5/2001 | Altfather et al. | |
| 6,866,372 | B2 | 3/2005 | Oda et al. | |
| 7,168,798 | B2 | 1/2007 | Samii et al. | |
| 7,533,974 | B2 * | 5/2009 | Ohnishi et al. | 347/85 |

FOREIGN PATENT DOCUMENTS

| | | |
|---|---|---|
| JP | 07-137275 | 5/1995 |
| JP | 10-329338 | 12/1998 |
| JP | 2001-219574 | 8/2001 |
| JP | 2001-225478 | 8/2001 |
| JP | 2002-052731 | 2/2002 |
| JP | 2002-178498 | 6/2002 |

* cited by examiner

*Primary Examiner* — Anh T. N. Vo
(74) *Attorney, Agent, or Firm* — Ditthavong Mori & Steiner, P.C.

(57) ABSTRACT

An ink jet printer system includes an ink jet head, a plurality of ink supplying cartridges, an ink flow channel and a control device. The ink flow channel connects the ink jet head and the plurality of ink supplying cartridges to supply ink from the plurality of ink supplying cartridges to the ink jet head. The control device is configured to sequentially supply ink from each of the plurality of ink supplying cartridges to the ink jet head.

6 Claims, 5 Drawing Sheets

Background Art

INK JET PRINTER, INK SUPPLY MECHANISM FOR THE INK JET PRINTER, AND INK SUPPLY METHOD

CROSS-REFERENCE TO RELATED APPLICATIONS

This application is a continuation application of U.S. patent application Ser. No. 10/548,335, which is a national stage application of PCT/JP2003/016911 filed Dec. 26, 2003, which claims priority under 35 U.S.C. §119 to Japanese Patent Application. No. 2003-25193, filed Jan. 31, 2003. The contents of these applications are incorporated herein by reference in their entirety.

BACKGROUND OF THE INVENTION

1. Field of the Invention

The present invention relates to an ink jet printer, an ink supply mechanism for an ink jet printer, and an ink supply method.

2. Discussion of the Background

As shown in FIG. 5, there is well known in the art the ink jet printer which prints patterns and/or letters composed of arrays of ink dots on the surface of a media (or a recording media) 30 such as a sheet placed on a platen 20 by moving an ink jet head 10 over the media 30 transversely (or longitudinally of the drawing) or longitudinally (or vertically of the drawing) with respect to the media 30, or by injecting ink droplets from nozzles 12 arranged on the lower face of the ink jet toward the surface of the media 30.

In a configuration of this printer, as shown in FIG. 5, an ink supplying cartridge 60 is replaceably fitted in an ink supply port 50 belonging to a printer body 40, so that the ink of the cartridge is supplied from the ink supply port 50 to the ink jet head 10 through the inside of a flexible long resin tube 52 or the like. The ink thus supplied to the ink jet head 10 is injected from the nozzles 12 arrayed on the lower face of said ink jet head to the surface of the media 30 placed on the platen 20.

In FIG. 5, the ink supply port 50 is spaced from the printer body 40 and drawn in an enlarged scale so as to clarify its configuration.

The ink jet printer thus configured is excellent in the handling property of its ink supply mechanism, in that the cartridge 60 fitted in the ink supply port 50 is replaced, when its ink is depleted, by another new cartridge 60 so that the ink charged into the new cartridge 60 can be easily supplied again to the ink jet head 10.

In case, however, the ink jet printer thus configured is continuously run day and night for a long time, the ink of the cartridge 60 fitted in the ink supply port 50 of the printer body may be depleted at night when the printer is unmanned without the monitoring eyes of the user. In other situations, the printer either stops without the depleted cartridge 60 being replaced by another new cartridge 60 or continues the so-called "idle run", in which the patterns or the letters are not printed on the media although the printer is acting.

In order to prevent this idle run or stop of the printer at night due to the ink depletion of the cartridge 60, there is a method for replacing the cartridge 60 fitted in the ink supply port 50 of the printer body and supplying the ink, in advance before the unmanned night by another new cartridge 60 filled up with the ink.

In this case, however, the cartridge 60 having been fitted in the ink supply port 50 of the printer body and supplying the ink is replaced before the unmanned night, although the ink is still left in a considerable amount, by the new cartridge 60.

Moreover, the cartridge 60 containing the ink of a considerable amount is uselessly discarded.

SUMMARY OF THE INVENTION

According to one aspect of the present invention, an ink jet printer system includes an ink jet head, a plurality of ink supplying cartridges, an ink flow channel and a control device. The ink flow channel connects the ink jet head and the plurality of ink supplying cartridges to supply ink from the plurality of ink supplying cartridges to the ink jet head. The control device is configured to sequentially supply ink from each of the plurality of ink supplying cartridges to the ink jet head.

According to another aspect of the present invention, an ink supply mechanism for an ink jet printer system includes a plurality of ink supplying cartridges, an ink flow channel, and a control device. The ink flow channel is configured to connect an ink jet head of the ink supply mechanism and the plurality of ink supplying cartridges to supply ink from the plurality of ink supplying cartridges to the ink jet head. The control device is configured to sequentially supply ink from each of the plurality of ink supplying cartridges to the ink jet head.

According to further aspect of the present invention, an ink supply method includes providing a plurality of ink supplying cartridges, connecting an ink jet head and the plurality of ink supplying cartridges to supply ink from the plurality of ink supplying cartridges to the ink jet head, and sequentially supplying ink from each of the plurality of ink supplying cartridges to the ink jet head.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENT

Figure 1:
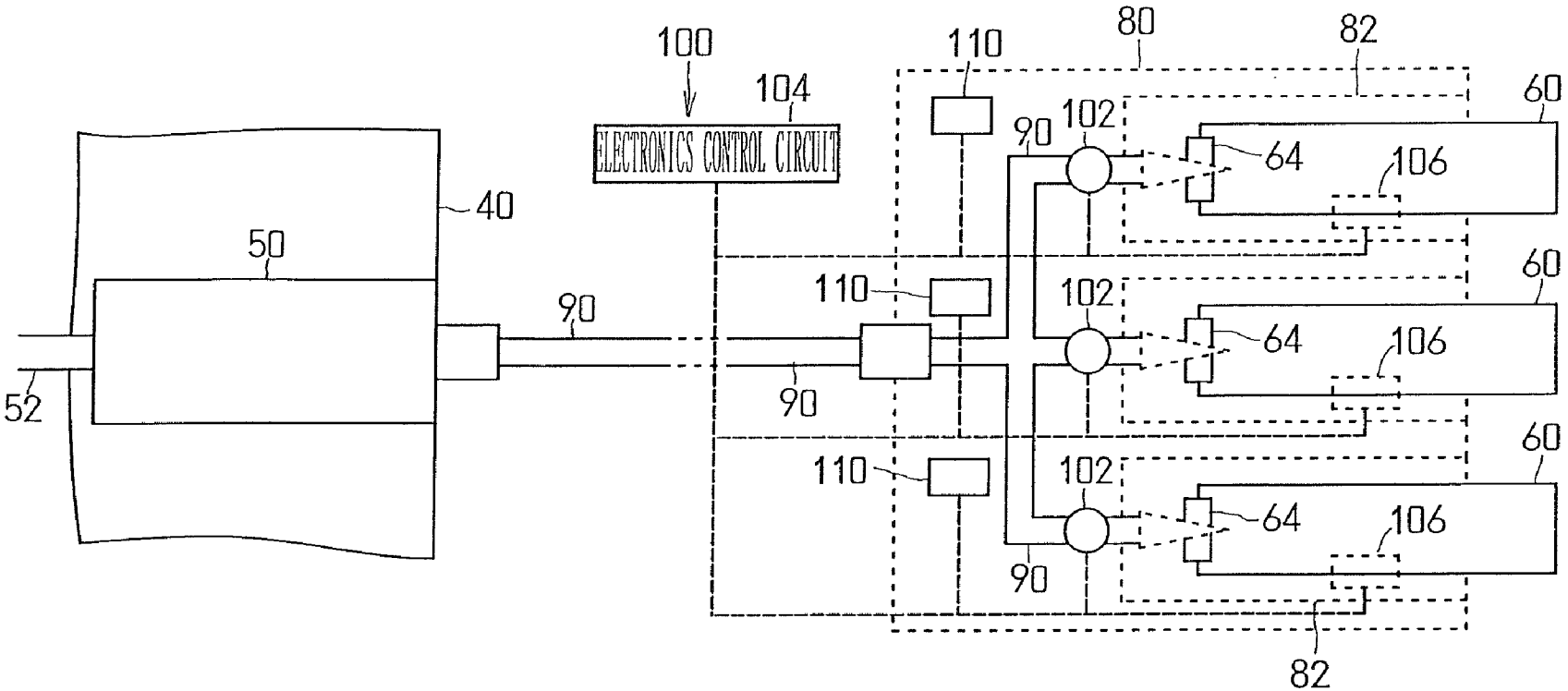
FIG. 1 is a schematic configuration explaining diagram of an ink jet printer equipped with a first ink supply mechanism according to an embodiment of the present invention.

Embodiments will now be described with reference to the accompanying drawings, wherein like reference numerals designate corresponding or identical elements throughout the various drawings.

FIG. 1 shows a preferred embodiment of a first ink supply mechanism of the invention.

Figure 5:
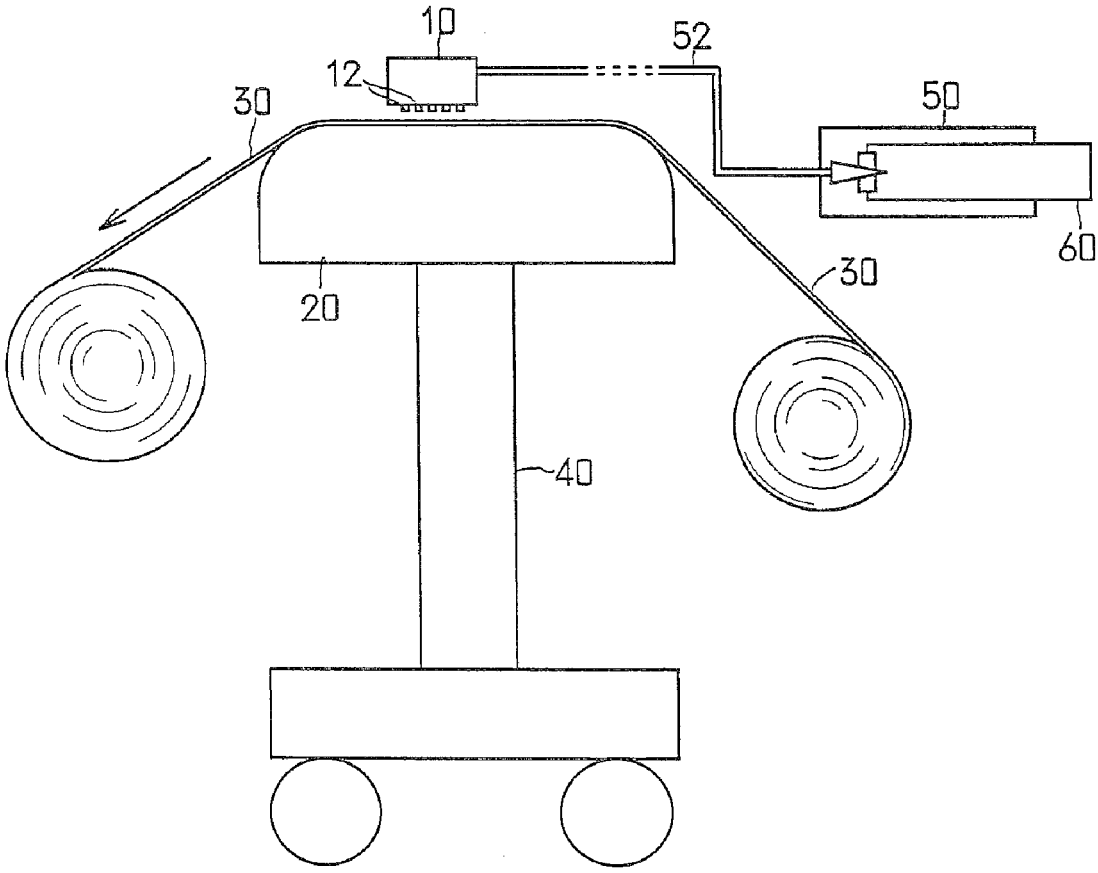
FIG. 5 is a schematic configuration explaining diagram of an ink jet printer.

This first ink supply mechanism is employed in an ink jet printer, in which a printer body 40 is equipped with an ink supply port 50 for supplying ink, as shown in the foregoing FIG. 5. The ink supply port 50 is connected to an ink jet head 10 through a flexible long resin tube 52 or the like so that the ink supplied to the ink supply port 50 is fed to the ink jet head 10 through the inside of the resin tube 52 or the like.

This first ink supply mechanism is equipped, as shown in FIG. 1, with a cartridge extension 80 having a plurality of slots 82, in which a plurality of ink supplying cartridges 60 are replaceably fitted.

The cartridge 60 is so configured, for example, that a soft pack of aluminum confining the ink is housed in a hard plastic container having an insertion port 64 to be replaceably fitted in the slot 82.

The cartridge extension 80 and the ink supply port 50 of the printer body are connected to each other through an ink flow channel 90 made of a plurality of resin tubes, as shown in FIG. 1. Moreover, the ink of the cartridge 60 inserted into each of the slots 82 of the cartridge extension is supplied through the ink flow channel 90 to the ink supply port 50 of the printer body.

Moreover, the ink is continuously supplied from one of the cartridges 60 individually fitted in the slots 82 of the cartridge extension, to the ink supply port 50 of the printer body through the ink flow channel 90 until the residual of the ink in the one cartridge 60 comes to zero or near. When this depletion is detected, the ink in the next cartridge 60 fitted in any of the slots 82 of the cartridge extension is continuously supplied to the ink supply port 50 of the printer body through the ink flow channel 90. This step is repetitively performed by electronic control type sequence control means 100 consecutively for the individual cartridges 60 fitted in the cartridge extension 80.

This sequence control means 100 is configured, as shown in FIG. 1, to include: solenoid valves 102 disposed at individual portions of the ink flow channel 90; an electronic control circuit 104 for opening/closing the valves automatically; and detectors 106 for detecting the depletions of ink contents in the individual cartridges 60 fitted in the slots 82 of the cartridge extension. The sequence control means 100 is configured to feed the ink contents of the individual cartridges 60 fitted in the slots 82 of the cartridge extension, while applying a pressure within a desired range, into nozzles 12 of the ink jet head through the ink flow channel 90 by utilizing the head difference between the ink levels in the cartridges 60 and the ink levels in the nozzles 12 of the ink jet head.

The first ink supply mechanism shown in FIG. 1 has the configuration thus far described.

Figure 2:
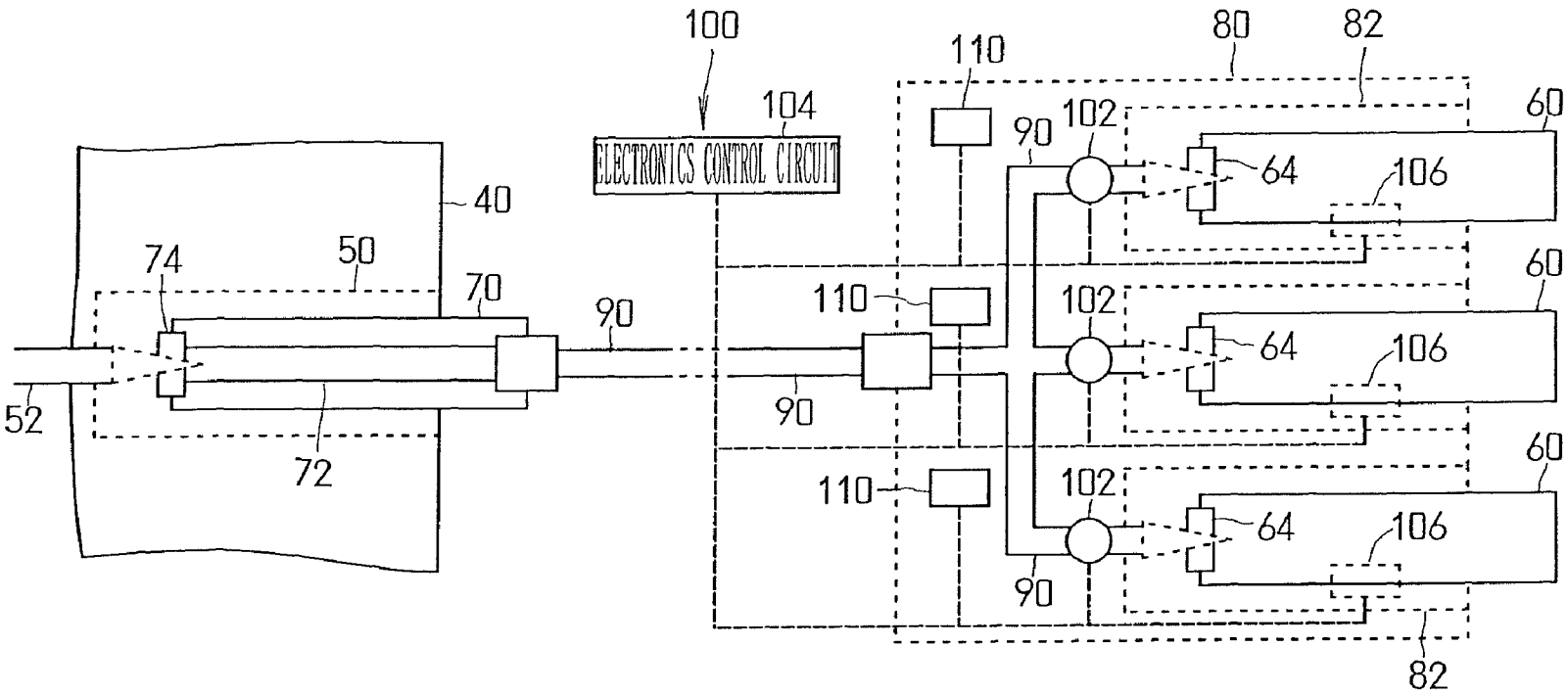
FIG. 2 is a schematic configuration explaining diagram of an ink jet printer equipped with a second ink supply mechanism according to an embodiment of the present invention.

FIG. 2 shows a preferred embodiment of the second ink supply mechanism of the invention.

This second ink supply mechanism is employed in the ink jet printer equipped in its body 40 with the ink supply port 50, into which the ink supplying cartridges 60 are replaceably fitted, as shown in FIG. 5. The ink supply port 50 is connected to the ink jet head 10 through the flexible long resin tube 52 or the like so that the ink supplied to the ink supply port 50 is fed into the ink jet head 10 through the inside of the resin tube 52 or the like. The cartridge 60 to be replaceably fitted in the ink supply port 50 is so generally configured that a soft pack of aluminum confining the ink is housed in a hard plastic container having an insertion portion to be replaceably fitted in the ink supply port 50.

This second ink supply mechanism is equipped, as shown in FIG. 2, with a dummy cartridge 70 to be fitted replaceably with the ink supplying general-purpose cartridges 60 in the ink supply port 50 of the printer body, and the cartridge extension 80 having the plurality of slots 82, in which the ink supplying cartridges 60 are replaceably fitted.

The cartridge 60 to be replaceably fitted in the cartridge extension 80 is given such a configuration like that of the general-purpose cartridge 60 to be fitted in the ink supply port 50, for example, that a soft pack of aluminum confining the ink is housed in a hard plastic container having the insertion portion 64 to be replaceably fitted in the aforementioned slot 82.

In the dummy cartridge 70, insertion portion 74 to be fitted in the ink supply port 50 is formed to have a contour and a size identical to those of the insertion portion of the general-purpose cartridge 60 to be fitted in the ink supply port 50. Moreover, the dummy cartridge 70 is so configured as can be replaceably fitted in the ink supply port 50 of the printer body 40, in which the general-purpose cartridge 60 is fitted. The dummy cartridge 70 is simply configured to have an ink passage 72 therein, as shown in FIG. 2.

The dummy cartridge 70 and the cartridge extension 80 are connected to each other, as shown in FIG. 2, through the ink flow channel 90 for supplying the ink of the cartridge 60 fitted in each of the slots 82 of the cartridge extension, to the ink supply port 50 of the printer body having that dummy cartridge fitted therein, through the ink passage 72 inside of the dummy cartridge. The ink flow channel 90 is formed by connecting a plurality of resin tubes or the like.

Moreover, the ink is continuously supplied from one of the cartridges 60 individually fitted in the slots 82 of the cartridge extension, to the ink supply port 50 of the printer body through the ink flow channel 90 and the ink passage 72 of the dummy cartridge fitted in the ink supply port 50 until the residual of the ink in the one cartridge 60 comes to zero or near. When this depletion is detected, the ink in the next cartridge 60 fitted in any of the slots 82 of the cartridge extension is continuously supplied to the ink supply port 50 of the printer body through the ink flow channel 90 and the ink passage 72 inside of the dummy cartridge. This step is repetitively performed by electronic control type sequence control means 100 consecutively for the individual cartridges 60 fitted in the cartridge extension 80. This sequence control means 100 is configured, as shown in FIG. 2, to include: solenoid valves 102 disposed at individual portions of the ink flow channel 90; an electronic control circuit 104 for opening/closing the valves automatically; and detectors 106 for detecting the depletions of ink contents in the individual cartridges 60 fitted in the slots 82 of the cartridge extension. The sequence control means 100 is configured to feed the ink contained in the individual cartridges 60 fitted in the slots 82 of the cartridge extension, while applying a pressure within a desired range, into nozzles 12 of the ink jet head through the ink flow channel 90, the ink passage 72 inside of the dummy cartridge fitted in the ink supply port 50 and the ink supply port 50, by utilizing the head difference between the ink levels in the cartridges 60 and the ink levels in the nozzles 12 of the ink jet head.

The second ink supply mechanism shown in FIG. 2 has the configuration thus far described.

Here will be described the examples of using those first and second ink supply mechanisms and their actions.

When the first ink supply mechanism is employed, the sequence control means 100 is used to supply the ink continuously from any one of the cartridges 60 individually fitted in the slots 82 of the cartridge extension, to the ink supply port 50 of the printer body through the ink flow channel 90 made of the resin tube and the like.

When the second ink supply mechanism is employed, on the other hand, the dummy cartridge 70 is fitted in place of the ink supplying general-purpose cartridge 60 in the ink supply port 50 of the printer body, as shown in FIG. 2. By using the sequence control means 100, moreover, the ink from any of the cartridges 60 individually fitted in the slots 82 of the cartridge extension is continuously supplied to the ink supply port 50 of the printer body through the ink flow channel 90 made of the resin tube or the like and the ink passage 72 inside of the dummy cartridge fitted in the ink supply port 50.

At an unmanned night while the ink jet printer equipped with that first or second ink supply mechanism is being employed, the ink is then continuously supplied from one of the cartridges 60 individually fitted in the slots 82 of the cartridge extension, to the ink supply port 50 until the residual of the ink in the one cartridge 60 comes to zero or near. This depletion of ink in one cartridge 60 supplying the ink can be detected by the sequence control means 100. The ink in the next new cartridge 60, in place of the cartridge 60, fitted in any of the slots 82 of the same cartridge extension is continuously supplied to the ink supply port 50 through the ink flow channel 90 in the case of the first ink supply mechanism and through the ink flow channel 90 and the ink passage 72 inside of the dummy cartridge fitted in the ink supply port 50 in the case of the second ink supply mechanism. This step can be automatically performed by the electronic control type sequence control means 100.

For the individual cartridges 60 fitted in the slots 82 of the cartridge extension, the same step as the aforementioned one can be repeated automatically and repetitively by using the sequence control means 100. As a result, it is possible to avoid the situations, in which the ink depletion of the cartridge 60 might occur at an unmanned night while the ink jet printer is being employed, causing to stop or idly run the ink jet printer.

Moreover, the cartridge 60 fitted in any of the slots 82 of the cartridge extension and depleted of ink can be replaced by another new cartridge 60 filled with sufficient ink, in the state not interrupting but continuing the printing operation by the ink jet printer, while the ink supply port 50 is being supplied with the ink of the other cartridge 60 fitted in any of the slots 82 of the same cartridge extension. When another chance for supplying the ink of the new cartridge 60 to the ink supply port 50 comes, the sequence control means 100 can be used like before to supply the ink of the new cartridge 60 continuously to the ink supply port 50 through the ink flow channel 90 in the case of the first ink supply mechanism and through the ink flow channel 90 and the ink passage 72 inside of the dummy cartridge fitted in the ink supply port 50 in the case of the second ink supply mechanism.

On either the individual cartridges 60 fitted in the slots 82 of the cartridge extension or any of the new cartridge 60 of the slots 82 of the cartridge extension, the same step as the aforementioned one can be repeated automatically and sequentially by using the sequence control means 100. Moreover, the ink supply port 50 of the printer body being continuously employed can be supplied with the ink continuously without any depletion for a long time.

Moreover, these first and second ink supply mechanisms are configured, as described above, such that the sequence control means 100 detects that the ink of one of the cartridges 60 individually fitted in the slots 82 of the cartridge extension is depleted. After the ink being supplied from one of the cartridges 60 was exploited without any waste, in place of the cartridge 60 depleted of the ink, the ink of the new cartridge 60 fitted in any of the slots 82 of the cartridge extension is continuously supplied by the sequence control means 100 to the ink supply port 50 of the printer body through the ink flow channel 90 in the case of the first ink supply mechanism and through the ink flow channel 90 and the ink passage 72 inside of the dummy cartridge fitted in the ink supply port 50 in the case of the second ink supply mechanism.

Therefore, the ink contained in the cartridges 60 individually fitted in the slots 82 of the cartridge extension can be sequentially used up completely. Moreover, the individual cartridges 60 fitted in the slots 82 of the cartridge extension can be prevented from being wastefully discarded with the ink being not used up completely but left in a considerable amount.

In these first and second ink supply mechanisms, as shown in FIG. 1 and FIG. 2, the detector 106 or the like of the sequence control means may be equipped with warning means 110 for notifying the printer user of the depletion of the ink of the cartridge 60, when the detector 106 of the sequence control means detects that the cartridge 60 fitted in the cartridge extension 80 and supplying the ink is depleted of the ink to be supplied. The warning means 110 may be configured to notify the printer user with a light or sound or vibrations and can be exemplified by a warning light lamp or a warning sound buzzer.

Moreover, the warning means 110 may be able to notify it reliably with no error that the cartridge 60 fitted in the cartridge extension 80 and supplying the ink is depleted of the ink. Then, the printer user may replace the depleted cartridge 60 by another new cartridge 60 filled sufficiently with the ink, and may fit the new cartridge 60 without delay in the slot 82 of the cartridge extension.

Figure 3:
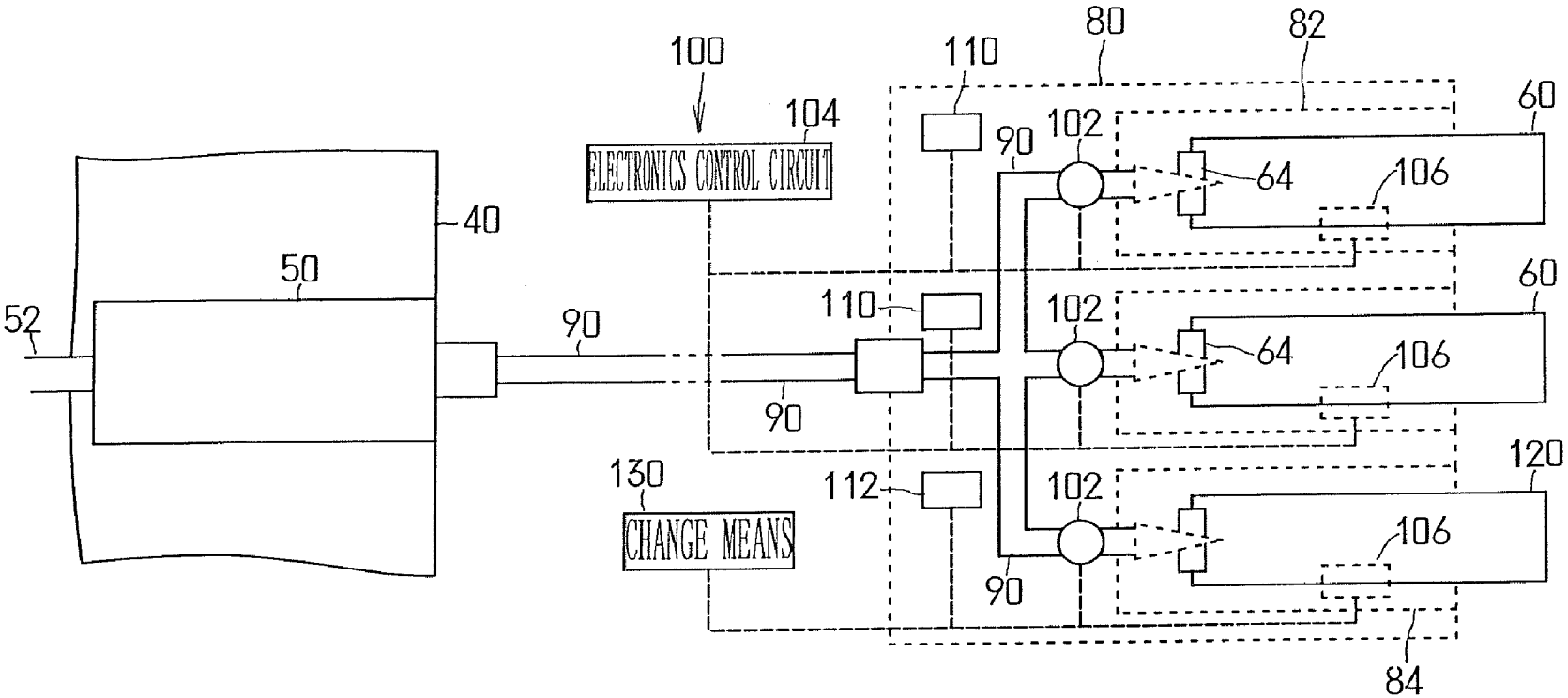
FIG. 3 is a schematic configuration explaining diagram of another ink jet printer equipped with the first ink supply mechanism according to an embodiment of the present invention.
Figure 4:
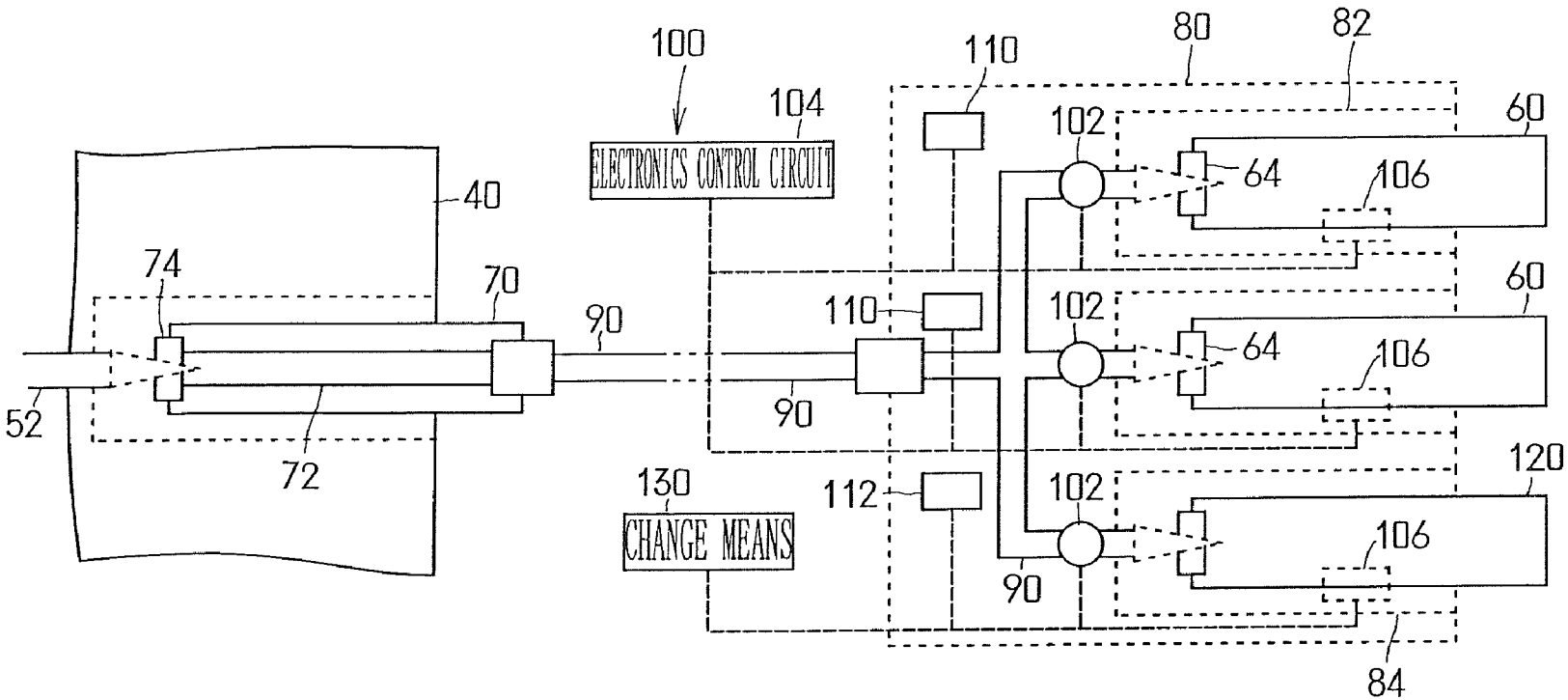
FIG. 4 is a schematic configuration explaining diagram of another ink jet printer equipped with the second ink supply mechanism according to an embodiment of the present invention.

In these first and second ink supply mechanisms, the cartridge extension 80 may be equipped, as shown in FIG. 3 and FIG. 4, with an insertion portion 84 for replaceably fitting a cleaning cartridge 120 for supplying a cleaning liquid. There may also be provided with an electronic control type or manual operation type change means 130 for supplying the cleaning liquid of the cleaning cartridge 120 fitted in that insertion portion 84, in place of the ink of the ink supplying cartridge 60 fitted in the slot 82 of the same cartridge extension, to the ink supply port 50 of the printer body through the ink flow channel 90 in the case of the first ink supply mechanism and through the ink flow channel 90 and the ink passage 72 inside of the dummy cartridge fitted in the ink supply port 50 in the case of the second ink supply mechanism. The change means 130 may be configured by using the solenoid valve 102 or the electronic control circuit 104 of the aforementioned sequence control means, an electronic circuit packaged in a host computer for driving the printer, or an electronic circuit packaged in the printer body. The change means 130 may be configured to feed the cleaning liquid of the cleaning cartridge 120 fitted in the insertion portion 84 of the cartridge extension, through the ink flow channel 90 in the case of the first ink supply mechanism and through the ink flow channel 90 and the ink passage 72 of the dummy cartridge fitted in the ink supply port 50 in the case of the second ink supply mechanism, while applying a pressure within a desired range from the ink supply port 50 to the inside of the nozzles 12 of the ink jet head, by utilizing the head difference between the cleaning liquid levels in the cleaning cartridge 120 and the cleaning liquid levels in the nozzles 12 of the ink jet head. The cleaning cartridge 120 may be formed, for example, to have a configuration and a size identical to those of the ink supplying cartridge 60 containing the cleaning liquid in place of the ink.

When the ink jet printer is left unused for a long time or when the ink jet printer is transported, the insertion portion 84 of the cartridge extension may have the cleaning cartridge 120 fitted therein. Moreover, the cleaning liquid of the cleaning cartridge 120 fitted in the insertion portion 84 may be fed, in place of the ink of the ink supplying cartridge 60 fitted in the slot 82 of the same cartridge extension, to the ink supply port 50 of the printer body through the ink flow channel 90 in the case of the first ink supply mechanism and through the ink flow channel 90 and the ink passage 72 inside of the dummy cartridge fitted in the ink supply port 50, by means of the change means 130. The cleaning liquid may be circulated in the nozzles 12 arranged on the ink jet head so that it may be ejected into the (not-shown) cleaning liquid pan disposed below the nozzles 12. Moreover, the ink, which might otherwise reside in the ink flow channel 90, the ink passage 72 of the dummy cartridge and the nozzles 12, may be washed away with the cleaning liquid and cleared away from the inside of the ink passage 72 of the dummy cartridge or from the inside of the nozzles 12. While the ink jet printer is not used for a long time or when the ink jet printer is transported, moreover, the ink, which might otherwise be left in the ink flow channel 90, the ink passage 72 of the dummy cartridge and the diametrically small nozzles 12, may be prevented from being solidified to clog the ink flow channel 90, the ink passage 72 of the dummy cartridge or the nozzles 12.

When the cleaning liquid in the cleaning cartridge 120 is used up completely the cleaning cartridge 120 may be pulled out from the insertion portion 84 of the cartridge extension and replaced by another new cleaning cartridge 120 filled up with the cleaning liquid. The cleaning liquid of the new cleaning cartridge 120 may likewise be circulated in the ink flow channel 90, the ink passage 72 inside of the dummy cartridge and the nozzles 12 arranged on the ink jet head by means of the change means 130 and may be discharged into the its pan disposed below the nozzles 12. The ink left in the ink flow channel 90, the ink passage 72 of the dummy cartridge and the nozzles 12 may be continuously and sufficiently washed away with the cleaning liquid.

In the first or second ink supply mechanism equipped with the insertion portion 84 of the cleaning cartridge 120 and the change means 130, there may be provided warning means 112 such as a lamp or buzzer for notifying the printer user of the depletion of the cleaning liquid of the cleaning cartridge 120, when it is detected by the detector 106 or the like that the residue of the cleaning liquid of the cleaning cartridge 120 fitted in the insertion portion 84 of the cartridge extension is depleted, as shown in FIG. 3 and FIG. 4.

Moreover, the warning means 112 may be able to notify the user reliably without any oversight that the cleaning liquid of the cleaning cartridge 120 fitted in the insertion portion 84 of the cartridge extension has been depleted. Then, the printer user may be able to replace the cleaning cartridge 120 having its cleaning liquid used up completely, by another new cleaning cartridge 120 filled up with the cleaning liquid, and to fit the new cleaning cartridge 120 in the insertion portion 84 of the cartridge extension without delay.

In this first or second ink supply mechanism, the ink supplying cartridge 60 to be fitted in the slot 82 of the cartridge extension or the cleaning cartridge 120 to be fitted in the insertion portion 84 of the cartridge extension may have the same configuration and size as those of the general-purpose cartridge 60 to be fitted in the ink supply port 50 of the printer body, but can have a configuration and a size different from those of the general-purpose cartridge 60.

In the second ink supply mechanism, on the other hand, the dummy cartridge 70 to be used may be contoured to have the same shape and size as those of the general-purpose cartridge 60, but can have a shape and a size different from those of the general-purpose cartridge 60.

In case the dummy cartridge 70 used in the second ink supply mechanism is contoured to have the same shape and size as those of the general-purpose cartridge 60, the dummy cartridge 70 can be so fitted in the ink supply port 50 of the printer body as can be replaced by the ink supplying general-purpose cartridge 60. Moreover, the second ink supply mechanism of the invention can be optically employed without any change in the configuration of the printer in the general ink jet printer having the printer body 40 equipped with the ink supply port 50 for fitting the general-purpose cartridge 60 replaceably. In short, the printer can be equipped with the second ink supply mechanism merely by fitting the dummy cartridge 70 in place of the ink supplying general-purpose cartridge 60 in the ink supply port 50 of the printer body.

These first and second ink supply mechanisms can be applied to printers using various kinds of ink such as aqueous pigment ink, aqueous dye ink, solvent ink, oil ink or UV ink (i.e., ink to be set with the irradiation of an ultraviolet ray).

Moreover, these first and second ink supply mechanisms can be provided for ink of different colors such as Yellow, Magenta, Cyan or Black to be supplied to the ink jet head 10.

By these individual ink supply mechanisms, the ink of different colors of Yellow, Magenta, Cyan and Black can be supplied continuously without any interruption to the ink jet head 10 for a long time.

By this first or second ink supply mechanism, the ink of one color such as Yellow, Magenta, Cyan or Black can naturally be supplied continuously without any interruption to the ink jet head 10 for a long time.

It should be noted that the exemplary embodiments depicted and described herein set forth the preferred embodiments of the present invention, and are not meant to limit the scope of the claims hereto in any way. Numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. An ink jet printer system comprising:

an ink jet head;

a plurality of ink supplying cartridges;

an ink flow channel connecting the ink jet head and the plurality of ink supplying cartridges to supply ink from the plurality of ink supplying cartridges to the ink jet head;

a control device configured to sequentially supply ink from each of the plurality of ink supplying cartridges to the ink jet head;

a cleaning cartridge containing cleaning liquid and connected to the ink jet head via the ink flow channel; and a change device configured to supply the cleaning liquid from the cleaning cartridge to the ink jet head via the ink flow channel.

2. The ink jet printer system according to claim 1, further comprising:

a warning device configured to notify a printer user with sound or vibration that the ink in one of the plurality of ink supplying cartridges is depleted when the control device detects depletion of the ink.

3. The ink jet printer system according to claim 1, further comprising:

a dummy cartridge connecting the ink jet head and each of the plurality of ink supplying cartridges and including an ink passage extending through the dummy cartridge from a first end of the dummy cartridge connected to the plurality of ink supplying cartridges to a second end of the dummy cartridge connected to the ink jet head.

4. An ink supply mechanism for an ink jet printer system, comprising:

a plurality of ink supplying cartridges;

an ink flow channel configured to connect an ink jet head of the ink supply mechanism and the plurality of ink supplying cartridges to supply ink from the plurality of ink supplying cartridges to the ink jet head;

a control device configured to sequentially supply ink from each of the plurality of ink supplying cartridges to the ink jet head;

a cleaning cartridge containing cleaning liquid and connected to the ink jet head via the ink flow channel; and a change device configured to supply the cleaning liquid from the cleaning cartridge to the ink jet head via the ink flow channel.

5. The ink supply mechanism according to claim 4, further comprising:

a warning device configured to notify a printer user with sound or vibration that the ink in one of the plurality of ink supplying cartridges is depleted when the control device detects depletion of the ink.

6. The ink supply mechanism according to claim 4, further comprising:

a dummy cartridge connecting the ink jet head and each of the plurality of ink supplying cartridges and including an ink passage extending through the dummy cartridge from a first end of the dummy cartridge connected to the plurality of ink supplying cartridges to a second end of the dummy cartridge connected to the ink jet head.

* * * * *